US011001418B2

(12) United States Patent
Li

(10) Patent No.: US 11,001,418 B2
(45) Date of Patent: May 11, 2021

(54) BOTTLE CAP CAPABLE OF BEING OPENED BY ONE PRESS

(71) Applicant: Clownfish (Shanghai) Industrial Co., Ltd., Shanghai (CN)

(72) Inventor: Yuejun Li, Jiangyin (CN)

( * ) Notice: Subject to any disclaimer, the term of this patent is extended or adjusted under 35 U.S.C. 154(b) by 196 days.

(21) Appl. No.: 16/333,573

(22) PCT Filed: Aug. 17, 2018

(86) PCT No.: PCT/CN2018/101074
§ 371 (c)(1),
(2) Date: Mar. 19, 2019

(87) PCT Pub. No.: WO2019/037663
PCT Pub. Date: Feb. 28, 2019

(65) Prior Publication Data

US 2019/0233174 A1 Aug. 1, 2019

(30) Foreign Application Priority Data

Aug. 21, 2017 (CN) ..... 201710720300.0

(51) Int. Cl.
*B65D 41/16* (2006.01)
*B65D 41/18* (2006.01)

(52) U.S. Cl.
CPC ..... *B65D 41/165* (2013.01); *B65D 41/18* (2013.01)

(58) Field of Classification Search
CPC ..... B65D 41/165; B65D 41/18; B65D 41/16; B65D 43/16; B65D 53/02
(Continued)

(56) References Cited

U.S. PATENT DOCUMENTS 5,052,568 A * 10/1991 Simon ..... B65D 51/20 215/250
5,577,624 A * 11/1996 Berta ..... B65D 50/045 215/221

(Continued)

FOREIGN PATENT DOCUMENTS

CN 101496459 A 7/2009
CN 107380691 A 11/2017
WO 2014026090 A1 2/2014

OTHER PUBLICATIONS

International Search Report dated Nov. 2, 2018 in International application No. PCT/CN2018/101074.

*Primary Examiner* — Ernesto A Grano
(74) *Attorney, Agent, or Firm* — W&K IP

(57) ABSTRACT

A bottle cap capable of being opened by one press, comprising a bottle mouth (11) and a bottle cap (1), and further comprising a positioning ring (3), a fixing ring (10), and an oval elastic snap ring (8). A slot (13) is provided between the positioning ring (3) and the fixing ring (10); the two major axis ends of the elastic snap ring (8) are located in the slot (13); either of the two major axis ends of the elastic snap ring (8) is provided with a press piece (7); a groove (12) is circumferentially formed on the side wall of the bottle mouth (11) at a position corresponding to the elastic snap ring (8); the two minor axis ends of the elastic snap ring (8) are located in the groove (12) to lock the connection of the bottle cap (1) to the bottle mouth (11), and are configured to stretch as the press piece (7) is pressed, so as to disengage from the groove (12) and enter the slot (13), thereby unlocking the connection of the bottle cap (1) to the bottle mouth (11).

16 Claims, 6 Drawing Sheets

(58) Field of Classification Search
USPC ..... 215/303
See application file for complete search history.

(56) References Cited

U.S. PATENT DOCUMENTS

| | | | | |
|---|---|---|---|---|
| 5,941,402 | A * | 8/1999 | Krueger | B65D 50/046 215/209 |
| 8,448,814 | B2 * | 5/2013 | Yamamoto | H05K 5/0013 220/788 |
| 9,214,793 | B2 * | 12/2015 | Shiraki | H02G 3/088 |
| 9,387,976 | B2 * | 7/2016 | Geis | B65D 83/384 |
| 10,448,726 | B2 * | 10/2019 | Lin | A45D 40/24 |
| 2004/0245204 | A1 * | 12/2004 | Suffa | B65D 41/16 215/224 |
| 2007/0095838 | A1 * | 5/2007 | Roesler | B65D 43/021 220/326 |
| 2009/0236357 | A1 * | 9/2009 | Giraud | B65D 43/162 220/849 |
| 2012/0248129 | A1 * | 10/2012 | Yoshida | B65D 43/0212 220/780 |
| 2015/0101862 | A1 | 4/2015 | Shiraki | |
| 2017/0210545 | A1 * | 7/2017 | Graziano | B65D 1/0246 |
| 2019/0233174 | A1 | 8/2019 | Li | |
| 2020/0023391 | A1 * | 1/2020 | Cesare | B65D 47/0809 |

* cited by examiner

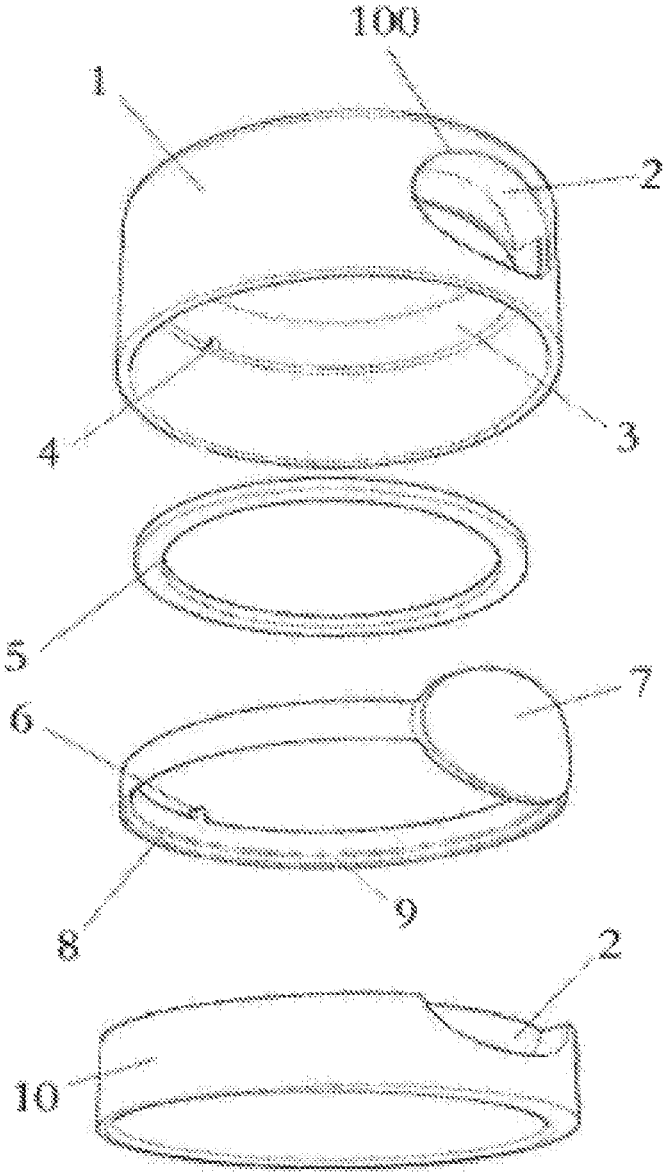
FIG. 1 is a schematic structural diagram of a bottle cap according to the present application.

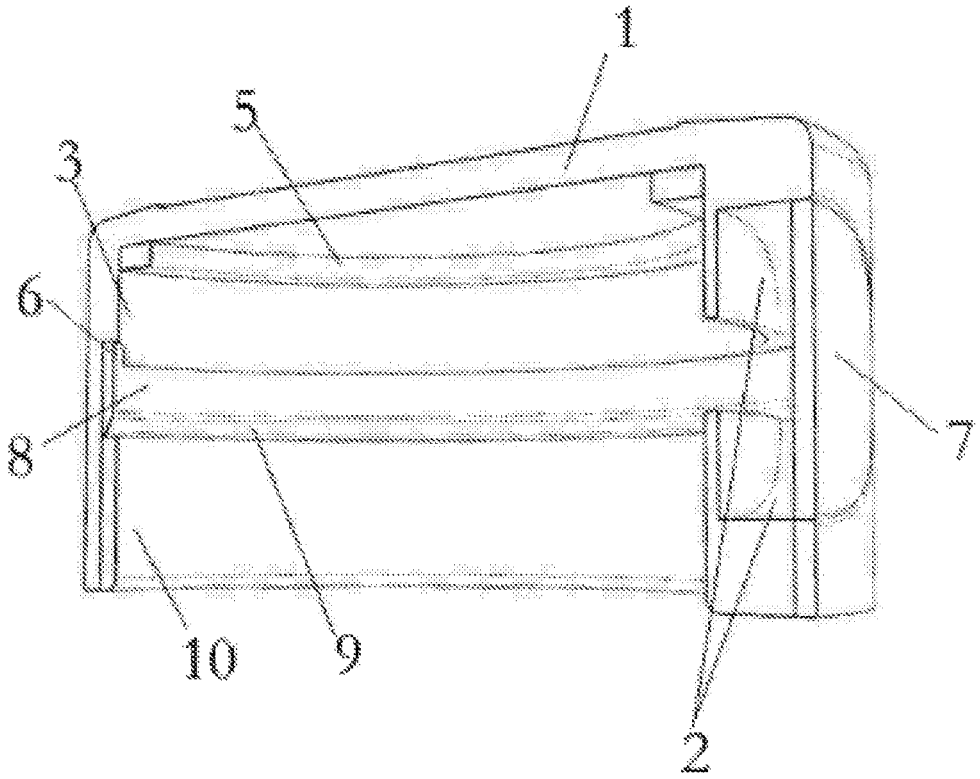
FIG. 2 is a cross-sectional perspective view of a bottle cap according to the present application.

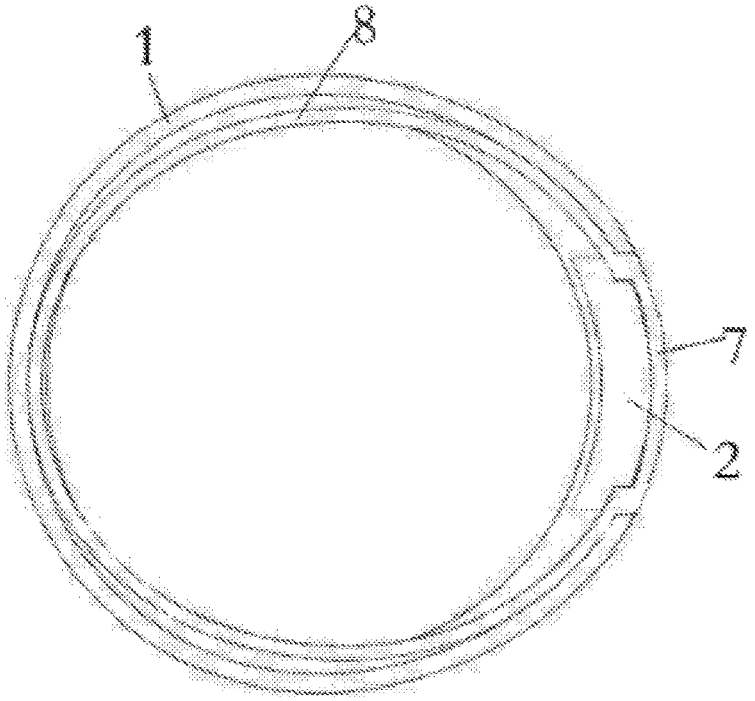
FIG. 3 is a cross-sectional view of a bottle cap in a covering state according to the present application.

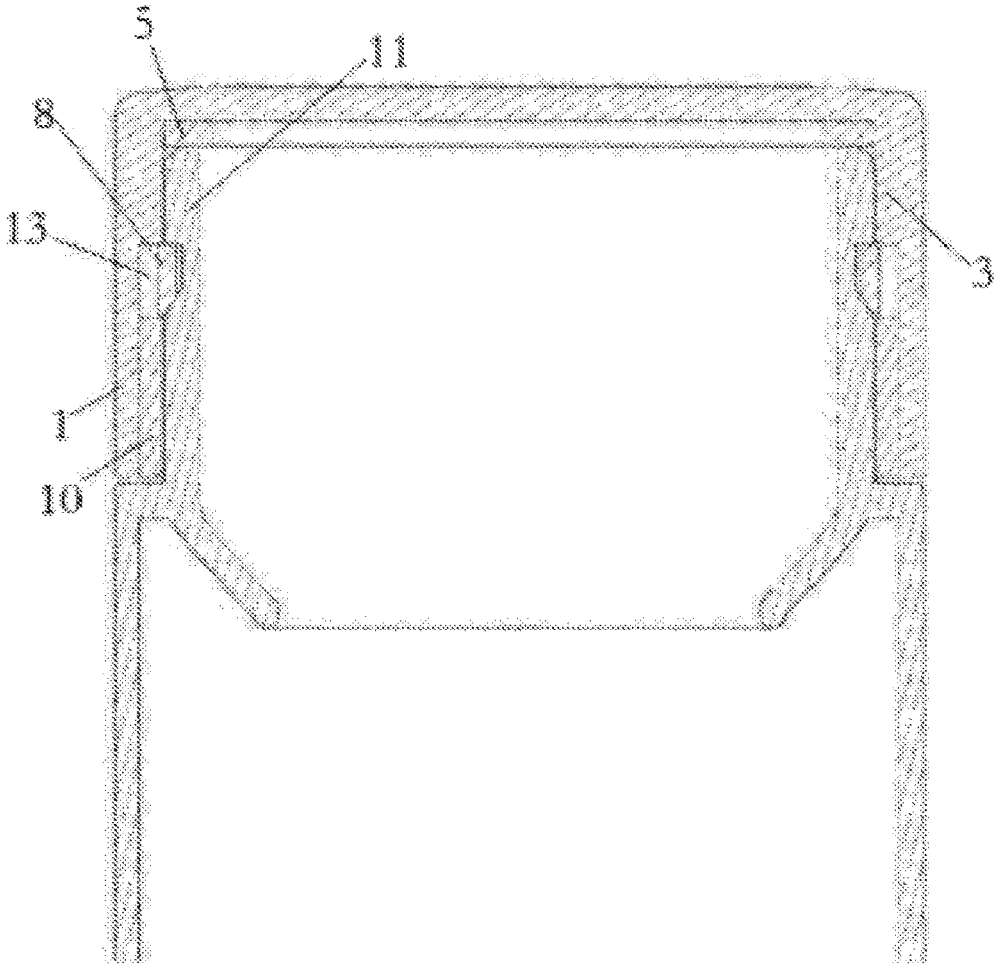
FIG. 4 is a cross sectional view of a bottle cap in a covering state according to the present application.

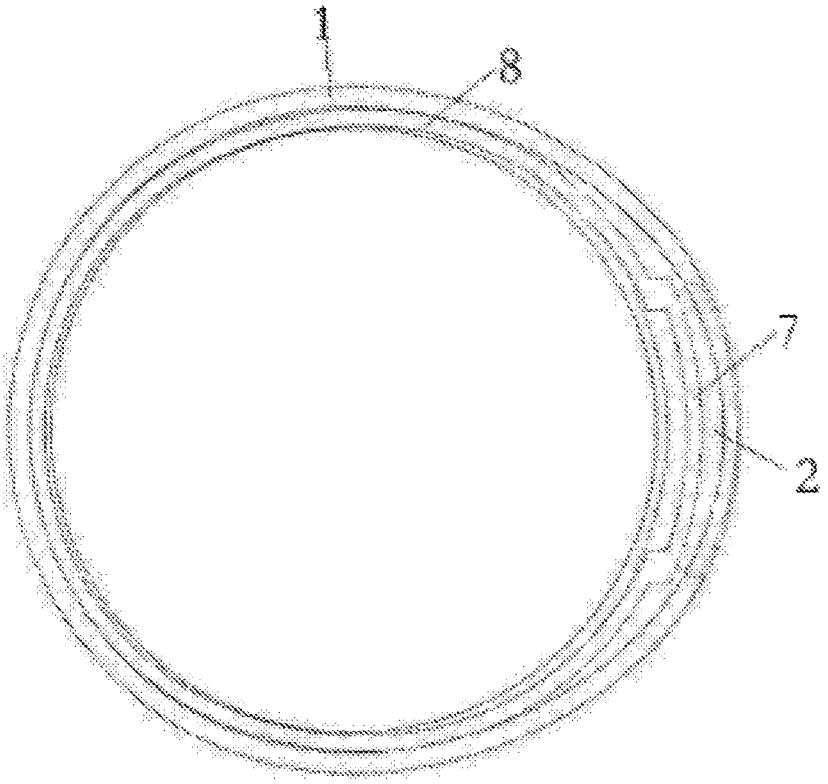
FIG. 5 is a cross-sectional view of a bottle cap in an open state according to the present application.

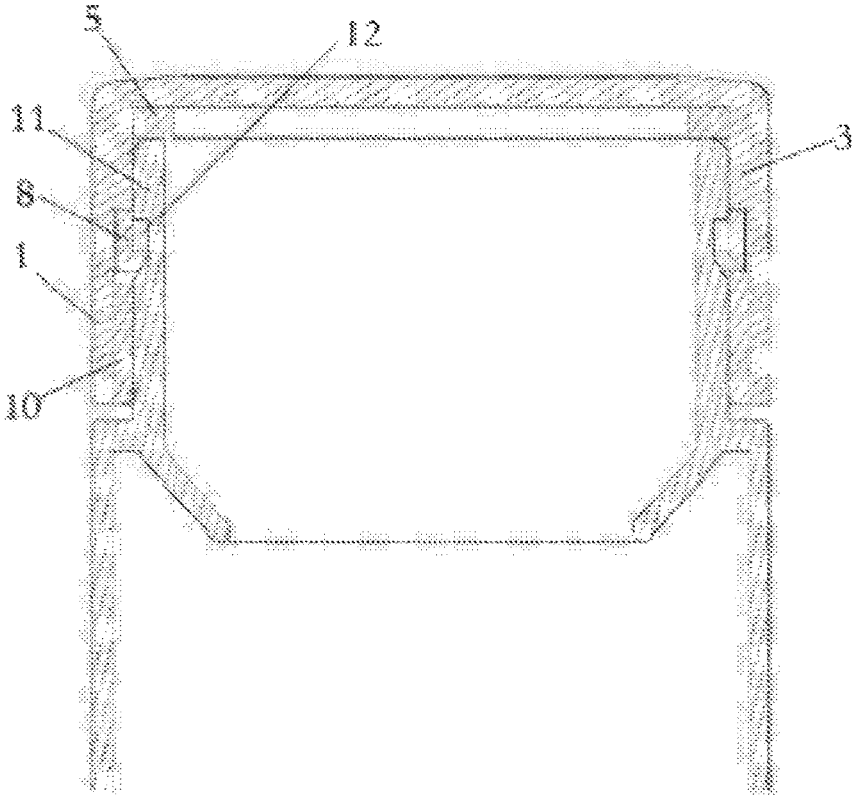
FIG. 6 is a cross sectional view of a bottle cap in an open state according to the present application.

BOTTLE CAP CAPABLE OF BEING OPENED BY ONE PRESS

CROSS-REFERENCE OF RELATED APPLICATIONS

The application claims the application number of 201710720300.0, filed on Aug. 21, 2017, and the application number of the Chinese patent office is 201710720300.0, the invention relates to the priority of the Chinese patent application named "bottle cap with one-key opening", all contents of which are described in the present application by reference.

TECHNICAL FIELD

The invention relates to a bottle cap, in particular to a bottle cap with one-key opening

BACKGROUND TECHNOLOGY

Drinking water bottle cap is a topic that few people have opened. In modern society, the life rhythm of people is fast, and even if people drink water, people can make the pursuit of simplicity, convenience and quickness. Therefore, a wide variety of water cups and matched functional bottle caps capable of conveniently and rapidly drinking water are also developed.

A bottle cap in the current market is mainly of a buckle type or spiral structure. A spiral structure generally needs to fix a bottle body by one hand, the bottle cap can be opened only by rotating the bottle cap by one hand, and the operation is complex and labor-consuming; the buckle type structure generally needs to fix the bottle body by one hand, the other hand is buckled with the buckle to be connected, the operation is more labor-consuming, and water in the bottle can be easily splashed out instantly when the bottle cap is opened, so that waste is caused; due to the fact that a large counter-acting force generated at the moment of opening of the bottle cap is easy to damage the fingers, and the safety is low.

APPLICATION CONTENT

The technical problem to be solved by the application is at least providing a simple structure, convenient and labor-saving in operation and safe and rapid in opening and closing.

According to the technical scheme, the technical scheme for solving the technical problem is as follows: an one-key opening bottle cap, a bottle opening and a bottle cap, and further comprises a positioning ring, a fixing ring and an oval elastic clamping ring, the positioning ring and the fixing ring are sequentially arranged in the bottle cap from top to bottom, and an interval is reserved between the positioning ring and the fixing ring, the two ends of the long shaft of the elastic clamping ring are located in the middle groove, and a pressing piece is arranged at one end of the long shaft of the elastic clamping ring, corresponding to the pressing piece, of the positioning ring and the fixing ring, and a cavity for containing the pressing piece is formed in the position, corresponding to the pressing piece, of the positioning ring and the fixing ring, and the pressing piece can move along the radial direction of the bottle cap in the cavity, a through hole communicated with the cavity is formed in the position, corresponding to the cavity, of the side wall of the bottle cap a clamping groove is formed in the position, corresponding to the elastic clamping ring, of the side wall of the bottle opening, and the two ends of the short shaft of the elastic clamping ring are located in the clamping grooves to lock the connection between the bottle cap and the bottle opening, and can be separated from the clamping groove along with the pressed opening of the pressing piece and enter the middle groove, so as to unlock the bottle cap to be connected with the bottle mouth.

The bottle cap has the beneficial effects that when the bottle cap and the bottle mouth are covered, and the two ends of the short shaft of the elastic clamping ring are located in the clamping grooves to lock the connection between the bottle cap and the bottle opening, when the bottle cap needs to be opened, the pressing piece is pressed to enable the elastic piece to be opened and the two ends of the short shaft of the clamping ring are opened to be separated from the clamping groove and enter the middle groove, so as to unlock the bottle cap to be connected with the bottle opening, so that the bottle cap can be taken down; and if the bottle cap needs to be re-covered, and the pressing piece is pressed to open the two ends of the short shaft of the elastic clamping ring, and the bottle cap is covered with the bottle opening, and the pressing piece is loosened to enable the two ends of the short shaft of the elastic clamping ring to be clamped into the clamping groove in the initial state, simple in structure, convenient and labor-saving in operation and safe and rapid in opening and closing.

Further, the bottle cap comprises a bottom wall and an annular side wall, and the annular side wall is fixed on the bottom wall, a cavity is defined between the inner wall of the annular side wall and the inner surface of the bottom wall.

Further, the positioning ring is fixed on the inner wall of the annular side wall, facing the bottom wall, of the positioning ring is attached to the inner surface of the bottom wall.

Further, the fixing ring is fixed on the inner wall of the annular side wall, far away from the bottom wall, of the fixing ring is flush with the end, away from the bottom wall, of the annular side wall.

Further, the positioning ring is internally provided with an upper end pressed by the upper end of the bottle opening wherein an elastic sealing gasket is arranged on the inner bottom wall of the bottle cap.

By adopting the further technical scheme, the elastic sealing gasket has the beneficial effects that the elastic sealing gasket is used, the sealing reliability of the bottle cap is ensured, and water leakage is prevented, and on the other hand, when the cover is opened, the opening is opened, after the pressing piece is pressed, the bottle cap is popped out, and the cover opening is more convenient and rapid.

Further, the elastic sealing gasket is in a circular ring shape, the elastic sealing gasket is fixed on the inner wall of the positioning ring, facing the bottom wall, of the elastic sealing gasket is attached to the inner surface of the bottom wall.

Further, fillet or chamfer is arranged on the outer edge of the top surface of the bottle opening.

Further, the elastic sealing gasket is an annular silica gel pad.

According to the technical scheme, the elastic sealing gasket has the beneficial effects that the sealing reliability and elasticity of the elastic sealing gasket are ensured to be stable and reliable.

Further, a positioning bulge is vertically arranged at one end, far away from the pressing piece, of the long shaft of the elastic clamping ring, and a positioning groove is formed in the position, corresponding to the positioning protrusion, of the lower end of the positioning ring, with the positioning groove; the positioning bulge is embedded into the positioning groove.

The technical scheme provided by the invention has the beneficial effects that the positioning bulge is matched with the positioning groove, and the limiting effect of the cavity to the pressing piece is combined, so that the elastic clamping ring can be prevented from rotating and offset in the middle groove.

Further, the positioning protrusions and the positioning grooves are multiple, a plurality of positioning protrusions are arranged at intervals along the circumferential direction of the elastic clamping ring, a plurality of positioning grooves and a plurality of positioning grooves; the positioning grooves are arranged at intervals along the circumferential direction of the positioning ring, the positioning protrusions and the positioning grooves are arranged in an one-to-one correspondence mode, and each positioning bulge is embedded into a positioning groove corresponding to the positioning bulge.

Further, the positioning bulge and the elastic clamping ring are integrally formed.

The technical scheme provided by the invention has the beneficial effects of being at least: so that the reliability of connection between the positioning bulge and the elastic clamping ring is improved.

Further, the positioning ring and the circumferential inner side wall of the bottle cap are integrally formed.

By adopting the further technical scheme, the bottle cap has the beneficial effects that the bottle cap and the positioning ring can be integrally produced and processed, the production cost can be reduced, and the structure reliability of the bottle cap can be improved.

Further, the pressing piece and the elastic clamping ring are integrally formed.

The technical scheme provided by the invention has the beneficial effects of being at least: so that the production cost can be reduced, and the reliability of connection between the pressing piece and the elastic clamping ring can be improved.

Further, the lower end surface of the elastic clamping ring is an inclined surface facing the inner side of the bottle cover.

The technical scheme provided by the invention has the beneficial effects that the lower end surface of the elastic clamping ring is used as an inclined surface, in the process that the bottle cap covers the bottle mouth, and the upper end of the bottle opening directly supports the elastic clamping ring when passing through the lower end of the elastic clamping ring, the bottle cap can be smoothly covered and returned to the bottle opening without pressing the pressing piece, so that the bottle cap is convenient to cover back to the bottle opening conveniently.

Further, the lower end face of the clamping groove is inclined downwards towards the outside of the bottle cap.

BRIEF DESCRIPTION OF THE DRAWINGS

In order to more clearly illustrate technical solutions in the embodiments of the present application or in the prior art, and the accompanying drawings required to be used in the description of the specific implementation mode or the prior art are briefly introduced below. In all drawings, like elements or parts are generally identified by like reference numerals. In the drawings, elements or parts are not necessarily drawn according to actual proportions.

FIG. 1 is a schematic structural diagram of a bottle cap according to the present application.

FIG. 2 is a cross-sectional perspective view of a bottle cap according to the present application.

FIG. 3 is a cross-sectional view of a bottle cap in a covering state according to the present application.

FIG. 4 is a cross sectional view of a bottle cap in a covering state according to the present application.

FIG. 5 is a cross-sectional view of a bottle cap in an open state according to the present application.

FIG. 6 is a cross sectional view of a bottle cap in an open state according to the present application.

REFERENCE NUMERALS

1—Bottle cap, 2—chamber, 3—positioning ring and 4—positioning groove; 5—elastic sealing pads, 6—positioning protrusions and 7—pressing sheets; 8—elastic clamping rings, 9—inclined surfaces, 10—fixing rings; 11 to a bottle opening, 12 to a clamping groove, 13 to an interval, and 100 to a through opening.

SPECIFIC IMPLEMENTATION MODE

The embodiments of the technical solution of the present application will be described in detail below with reference to the accompanying drawings. The following embodiments are only used for more clearly illustrating the technical solutions of the present application, so that the protection scope of the application can be limited only by being used as an example.

As shown in FIG. 1, FIG. 2, FIG. 3, FIG. 4, FIG. 5 and FIG. 6, a bottle cap which is opened by one key comprises a bottle opening 11 and a bottle cap 1, and further comprises a positioning ring 3, a fixing ring 10 and an oval elastic clamping ring 8, the positioning ring 3 and the fixing ring 10 are sequentially arranged in the bottle cap 1 from top to bottom, and an interval 13 is reserved between the positioning ring 3 and the fixing ring 10, and the two ends of the long shaft of the elastic clamping ring 8 are located in the middle groove 13, and a pressing piece 7 is arranged at one end of the long shaft of the elastic clamping ring 8, a cavity 2 for accommodating the pressing piece 7 is formed in the position, corresponding to the pressing piece 7, of the positioning ring 3 and the fixing ring 10, and the pressing piece 7 can move along the radial direction of the bottle cap 1 in the cavity 2, a through opening 100 communicated with the cavity 2 is formed in the position, corresponding to the cavity 2, of the side wall of the bottle cap 1 a clamping groove 12 is formed in the position, corresponding to the elastic clamping ring 8, of the side wall surrounding the bottle opening 11, and the two ends of the short shaft of the elastic clamping ring 8 are located in the clamping grooves 12 to lock the connection of the bottle cap 1 and the bottle opening 11, and can be separated from the clamping groove 12 along with the pressed opening of the pressing piece 7 and enter the middle groove 13, so as to unlock the connection of the bottle cap 1 and the bottle opening 11.

Bottle cap 1 and bottle opening 11, and the two ends of the short shaft of the elastic clamping ring 8 are located in the clamping grooves 12 to lock the connection of the bottle cap 1 and the bottle opening 11, when the bottle cap 1 needs to be opened, the pressing piece 7 is pressed to enable the two ends of the short shaft of the elastic clamping ring 8 to be opened to be separated from the clamping groove 12 and enter the middle groove 13, so as to unlock the connection between the bottle cap 1 and the bottle opening 11, so that the bottle cap 1 can be taken down, if the bottle cap 1 needs to be re-covered, the bottle cap 1 is directly covered back to the bottle opening 11, in the process that the bottle cap 1 covers the bottle opening 11, and the upper end of the bottle opening 11 directly supports the elastic clamping ring 8 when passing through the inclined surface 9 of the lower end of the elastic clamping ring 8, the bottle cap 1 can smoothly cover the bottle opening 11 without pressing the pressing piece 7, and the structure is simple, the operation is simple and convenient, the labor is saved, and the opening and closing cover is safe and rapid.

Specifically, the outer contour of the bottle cap 1 is cylindrical, the bottle cap 1 comprises a bottom wall and an annular side wall, and the annular side wall is fixed on the bottom wall, and a cylindrical cavity is defined by the inner wall of the annular side wall and the inner surface of the bottom wall in a surrounding mode, the cylindrical cavity is buckled on the bottle opening 11. The positioning ring 3 and the fixing ring 10 are annular, and the positioning ring 3 is fixed on the inner surface of the annular side wall, and the end surface of the positioning ring 3 facing the bottom wall is attached to the inner surface of the bottom wall; the fixing ring 10 is fixed on the inner surface of the annular side wall, far away from the bottom wall, of the fixing ring 10 is flush with the end, away from the bottom wall, of the annular side wall, along the axial direction of the bottle cap 1, the positioning ring 3 and the fixing ring 10 are arranged at intervals, and an interval 13 is formed between the positioning ring 3 and the fixing ring 10.

The bottle cap 1 is buckled on the bottle opening 11, the inner wall of the positioning ring 3 and the inner wall of the fixing ring 10 are tightly attached to the outer wall of the bottle opening 11 respectively, so that the sealing effect is enhanced.

A chamber 2 is arranged on the outer surface of the positioning ring 3, the cavity 2 on the positioning ring 3 can accommodate the end part of the pressing piece 7 towards the bottom wall; a cavity 2 is formed in the outer surface of the fixing ring 10, the cavity 2 of the fixing ring 10 can accommodate the end part of the pressing piece 7 away from the bottom wall, and a through opening 100 is formed in the annular side wall, the position of the through opening 100 corresponds to the cavity 2 on the positioning ring 3 and the cavity 2 on the fixing ring 10, so that the cavity 2 on the positioning ring 3 and the cavity 2 on the fixing ring 10 are exposed, and the pressing piece 7 can be arranged in the through opening 100, and can extend into or out of the cavity 2 along the radial direction of the bottle cap 1 according to the sheet 7.

When bottle cap 1 needs to be opened, the pressing piece 7 is pressed to enable the two ends of the short shaft of the elastic clamping ring 8 to be opened to be separated from the clamping groove 12 and enter the middle groove 13, so as to unlock the connection of the bottle cap 1 and the bottle opening 11, the cavity 2 can play a role in limiting the bottle cap 1 in the process of opening the bottle cap 1, when the pressing piece 7 moves to a position which is in contact with the cavity body, the two ends of the short shaft of the elastic clamping ring 8 are just separated from the clamping groove 12, and the accuracy of opening the bottle cap 1 can be improved; and the through opening 100 and the cavity 2 can play a role in guiding and can be moved when the sheet 7 is moved, and can move according to the path of a channel formed by the through opening 100 and the cavity 2 according to the sheet 7, so that the elastic clamping ring 8 is driven to move according to a preset track, so that the bottle cap 1 is prevented from being opened due to deviation of the moving track of the elastic clamping ring 8.

Optionally, the positioning ring 3 is internally provided with an upper end pressed by the upper end of the bottle opening 11 wherein the elastic sealing gasket 5 is arranged on the inner bottom wall of the bottle cap 1, the elastic sealing gasket 5 is in a circular ring shape, and the elastic sealing gasket 5 is fixed on the inner wall of the positioning ring 3, facing the bottom wall, of the elastic sealing gasket 5 is attached to the inner surface of the bottom wall.

Optionally, rounded corners or chamfers are arranged on the outer edge of the top surface of the bottle mouth 11, after the bottle cap 1 is covered on the bottle opening 11, and the bottle opening 11 is tightly pressed on the elastic sealing gasket 5, the sealing quantity can be increased by the arrangement of the round angle or the chamfer angle, and the sealing performance can be improved.

By means of the elastic sealing pad 5, on one hand, the sealing reliability of the bottle cap 1 is ensured, so that water can be prevented from leaking, and on the other hand, when the cover is opened, after the pressing piece 7 is pressed, the bottle cap 1 is popped out, and the cover opening is more convenient and rapid.

Optionally, the elastic sealing pad 5 is an annular silica gel pad. The sealing reliability and elasticity of the elastic sealing gasket 5 are ensured to be stable and reliable.

Optionally, a positioning bulge 6 is vertically arranged at one end, far away from the pressing sheet 7, of the long shaft of the elastic clamping ring 8. A positioning groove 4 is formed in the position, corresponding to the positioning protrusion 6, of the lower end of the positioning ring 3, wherein the positioning bulge 6 is embedded into the positioning groove 4; the positioning bulge 6 is embedded into the positioning groove 4.

The positioning protrusion 6 is matched with the positioning groove 4, and the limiting effect of the cavity 2 on the pressing piece 7 is combined, so as to prevent the elastic clamping ring 8 from rotating and offset in the slot 13.

The positioning protrusions 6 can be one or more, and the positioning grooves 4 can be one or more, the positioning protrusions 6 and the positioning grooves 4 can be arranged in a one-to-one correspondence manner.

A plurality of positioning protrusions 6 and a plurality of positioning grooves 4 are arranged, and a plurality of positioning protrusions 6 are arranged at intervals along the circumferential direction of the elastic clamping ring 8, and the plurality of positioning grooves 4 are arranged at intervals along the axial direction of the positioning ring 3, the positioning bulges 6 and the positioning grooves 4 are arranged in an one-to-one correspondence manner, and each positioning bulge 6 is embedded into the positioning groove 4 corresponding to the positioning bulge 6. Through the positioning protrusions 6 and the positioning grooves 4, the limiting effect on the clamping rings can be enhanced, so as to further prevent the elastic clamping ring 8 from rotating and offset in the slot 13.

The positioning protrusion 6 is fixedly connected with the elastic clamping ring 8, and the connecting mode can be in any suitable manner such as bonding or connecting through fasteners.

Optionally, the positioning protrusion 6 and the elastic clamping ring 8 are integrally formed. The reliability of connection between the positioning bulge 6 and the elastic clamping ring 8 is improved.

The positioning ring 3 is fixedly connected with the circumferential inner side wall of the bottle cap 1, and the connecting mode can be in any suitable manner such as bonding or connecting through fasteners.

Optionally, the positioning ring 3 and the circumferential inner side wall of the bottle cap 1 are integrally formed. The invention discloses an integrated production and processing of a bottle cap 1 and a positioning ring 3 the production cost can be reduced, and the structural reliability of the bottle cap 1 can be improved.

The pressing piece 7 is fixedly connected with the elastic clamping ring 8, and the connecting mode can be in any suitable manner such as bonding or connecting through fasteners.

Optionally, the pressing piece 7 and the elastic clamping ring 8 are integrally formed. The production cost can be reduced, and the reliability of connection between the pressing sheet 7 and the elastic clamping ring 8 can be improved.

Optionally, the pressing piece 7 is rectangular and in the process of opening the bottle cap 1, the thumb and the index finger of an user form an annular sleeve to cover the side wall of the bottle cap 1, and at the moment, and the outer contour of the thumb of the user along the axial direction of the side wall of the bottle cap 1 is basically rectangular, and the shape of the pressing piece 7 is set to be a rectangle, so that the thumb of an user can be conveniently pressed to open the bottle cap 1, so that the convenience of opening the bottle cap 1 is improved.

Optionally, the lower end surface of the elastic clamping ring 8 is an inclined surface 9 towards the inner side of the bottle cap 1.

The lower end surface of the elastic clamping ring 8 is an inclined surface 9, and the bottle cap 1 is covered with the bottle opening 11, and the upper end of the bottle opening 11 directly supports the elastic clamping ring 8 when passing through the lower end of the elastic clamping ring 8, the bottle cap 1 can be smoothly covered and returned to the bottle opening 11 without pressing the pressing piece 7, so that the bottle cap 1 is convenient to cover the bottle opening 11 again.

Optionally, the lower end surface of the clamping groove 12 is inclined downwards towards the outside of the bottle cap 1, the lower end surface of the clamping groove 12 can be attached to the lower end surface of the elastic clamping ring 8, so that the process of stretching the elastic clamping ring 8 into and out of the clamping groove 12 can be more smooth.

In this embodiment, and an elastic sealing gasket 5 which is pressed on the inner bottom wall of the bottle cap 1 through the upper end of the bottle opening 11 is arranged in the positioning ring 3, the elastic sealing gasket 5 is an annular silica gel pad, and a positioning bulge 6 is vertically arranged at one end, far away from the pressing sheet 7, of the long shaft of the elastic clamping ring 8, a positioning groove 4 is formed in the position, corresponding to the positioning protrusion 6, of the lower end of the positioning ring 3, the positioning bulge 6 is embedded into the positioning groove 4, and the positioning bulge 6 and the elastic clamping ring 8 are integrally formed, the positioning ring 3 and the circumferential inner side wall of the bottle cap 1 are integrally formed, the pressing piece 7 and the elastic clamping ring 8 are integrally formed, and the lower end surface of the elastic clamping ring 8 is an inclined surface 9 towards the inner side of the bottle cap 1 The one-key opening bottle cap provided by the embodiment has at least the following use modes as shown in FIG. 3 and FIG. 4, when the bottle cap 1 is covered with the bottle opening 11, and the two ends of the short shaft of the elastic clamping ring 8 are located in the clamping grooves 12 to lock the connection of the bottle cap 1 and the bottle opening 11; as shown in FIG. 5 and FIG. 6, when the bottle cap 1 needs to be opened, the pressing piece 7 is pressed to enable the two ends of the short shaft of the elastic clamping ring 8 to be opened to be separated from the clamping groove 12 and enter the middle groove 13, so as to unlock the connection between the bottle cap 1 and the bottle opening 11, so that the bottle cap 1 can be taken down; as shown in FIG. 2, FIG. 3 and FIG. 4, if the bottle cap 1 needs to be re-covered, the bottle cap 1 is directly covered with the bottle opening 11, and the bottle cap 1 is covered with the bottle opening 11, and the upper end of the bottle opening 11 directly supports the elastic clamping ring 8 when passing through the inclined surface 9 of the lower end of the elastic clamping ring 8 So that the bottle cap 1 can be smoothly covered and returned to the bottle opening 11 without pressing the pressing sheet 7.

Finally, it should be noted that the above embodiments are only used to illustrate the technical solutions of the present application and are not limited thereto; although the application is described in detail with reference to the above embodiments, it should be understood by those skilled in the art: and the technical scheme described in the embodiments can still be modified, or equivalently replacing some or all of the technical features; and the modification or replacement, and the essence of the corresponding technical scheme is not separated from the scope of the technical scheme of the embodiments of the application, the method and the device of the invention are all covered in the scope of the claims and the specification of the application.

INDUSTRIAL PRACTICABILITY

The one-key opening bottle cap provided by the embodiment of the invention is simple and convenient to operate and labor-saving, the opening and closing are safe and fast, the production cost is low, and the structure reliability is high.

I claim:

1. A bottle cap with a one-key opening function, wherein the bottle cap (1) is engaged with a bottle opening (11), and the bottle cap (1) is characterized by further comprising a positioning ring (3), a fixing ring (10) and an oval elastic clamping ring (8), the positioning ring (3) and the fixing ring (10) are sequentially arranged on the bottle cap (1) from top to bottom, and an interval (13) is reserved between the positioning ring (3) and the fixing ring (10), wherein the interval (13) is defined as a middle groove (13); two ends of a long shaft of the oval elastic clamping ring (8) are positioned in the middle groove (13), and a pressing piece (7) is arranged at one end of the long shaft of the oval elastic clamping ring (8), a cavity (2) for accommodating the pressing piece (7) is provided in a position where the positioning ring (3) and the fixing ring (10) correspond to the pressing piece (7); a pressing sheet is provided to move along the bottle cap (1) in the cavity (2); a through-opening (100) communicating with the cavity (2) is formed in a position where a side wall of the bottle cap (1) corresponds to the cavity (2); a clamping groove (12) is formed in a position where a side wall surrounding the bottle opening (11) corresponds to the oval elastic clamping ring (8), and two ends of a short shaft of the oval elastic clamping ring (8) are positioned in the clamping groove (12) for locking connection between the bottle cap (1) and the bottle opening (11), and are to be released from the clamping groove (12) and enter the middle groove (13) when the pressing piece (7)

is pressed and opened so as to unlock the connection between the bottle cap (1) and the bottle opening (11).

2. The bottle cap with a one-key opening function according to claim 1, characterized in that the bottle cap (1) comprises a bottom wall and an annular side wall, and the annular side wall is fixed on the bottom wall, a cavity is defined between an inner wall of the annular side wall and an inner surface of the bottom wall.

3. The bottle cap with a one-key opening function according to claim 2, characterized in that the positioning ring (3) is fixed on the inner wall of the annular side wall; the positioning ring (3) facing a bottom surface of the bottom wall is attached to the inner surface of the bottom wall.

4. The bottle cap with a one-key opening function according to claim 3, characterized in that the fixing ring (10) is fixed on the inner wall of the annular side wall; an end of the fixing ring (10) distant from the bottom wall is flush with an end of the annular side wall distant from the bottom wall.

5. The bottle cap with a one-key opening function according to claim 1, characterized in that the positioning ring (3) is internally provided with an elastic sealing gasket (5) which compresses an upper end portion of the bottle opening (11) onto an inner bottom wall of the bottle cap (1).

6. The bottle cap with a one-key opening function according to claim 5, wherein the elastic sealing gasket is of a circular ring shape; the elastic sealing gasket (5) is fixed on an inner wall of the positioning ring, and an end surface of the elastic sealing gasket (5) facing the bottom wall is fitted to an inner surface of the bottom wall.

7. The bottle cap with a one-key opening function according to claim 5, characterized in that an outer circumferential border of the bottle opening (11) is provided with a round corner or a chamfer.

8. The bottle cap with a one-key opening function according to claim 6, characterized in that the elastic sealing gasket (5) is an annular silica gel pad.

9. The bottle cap with a one-key opening function according to claim 8, characterized in that a positioning bulge (6) is vertically arranged at one end of the elastic clamping ring (8) distant from the pressing piece (7); a positioning groove (4) is provided at a position of a lower end of the positioning ring (3) corresponding to the positioning bulge (6); the positioning bulge (6) is embedded into the positioning groove (4).

10. The bottle cap with a one-key opening according to claim 9, characterized in that a plurality of positioning bulges (6) and a plurality of the positioning grooves (4) are provided, wherein the plurality of positioning bulges (6) are arranged along a circumferential direction of the elastic clamping ring (8) at intervals; the plurality of positioning grooves (4) are provided along a circumferential direction of the positioning ring (3), and the plurality of positioning bulges (6) and the plurality of positioning grooves (4) are mutually engaged with each of the plurality of positioning bulges (6) inserted in one of the plurality of positioning grooves (4) corresponding thereto.

11. The bottle cap with a one-key opening function according to claim 9, characterized in that: the positioning bulge (6) and the elastic clamping ring (8) are integrally formed.

12. The bottle cap with a one-key opening function according to claim 10, characterized in that: the plurality of positioning bulges (6) and the elastic clamping ring (8) are integrally formed.

13. The bottle cap with a one-key opening function according to claim 1, characterized in that: the positioning ring (3) is integrally formed with an inner circumferential wall of the bottle cap (1).

14. The bottle cap with a one-key opening function according to claim 1, characterized in that the pressing piece (7) and the elastic clamping ring (8) are integrally formed.

15. The bottle cap with a one-key opening function according to claim 1, characterized in that: a lower end surface of the elastic clamping ring (8) is an inclining surface (9) towards an inner side of the bottle cap (1).

16. The bottle cap with one-key opening function according to claim 15, characterized in that: a lower end face of the clamping groove (12) is downwardly inclining towards an outer side of the bottle cap (1).

* * * * *